US012540784B2

(12) United States Patent
Zoli

(10) Patent No.: US 12,540,784 B2
(45) Date of Patent: Feb. 3, 2026

(54) BREAK-BARREL FIREARM WITH MECHANICAL EXTRACTION ASSEMBLY

(71) Applicant: ZOLI ANTONIO S.r.l., Gardone val Trompia (IT)

(72) Inventor: Paolo Zoli, Gardone Val Trompia (IT)

(73) Assignee: ZOLI ANTONIO S.r.l., Gardone val Trompia (IT)

( * ) Notice: Subject to any disclaimer, the term of this patent is extended or adjusted under 35 U.S.C. 154(b) by 0 days.

(21) Appl. No.: 18/962,496

(22) Filed: Nov. 27, 2024

(65) Prior Publication Data

US 2025/0180310 A1 Jun. 5, 2025

(30) Foreign Application Priority Data

Dec. 1, 2023 (EP) ..... 23425065

(51) Int. Cl.
*F41A 3/58* (2006.01)
*F41A 15/06* (2006.01)
*F41C 7/11* (2006.01)

(52) U.S. Cl.
CPC ..... *F41A 3/58* (2013.01); *F41A 15/06* (2013.01); *F41C 7/11* (2013.01)

(58) Field of Classification Search
None
See application file for complete search history.

(56) References Cited

U.S. PATENT DOCUMENTS 375,626 A * 12/1887 Hampton ..... F41A 15/06 42/48
401,101 A * 4/1889 Anson ..... F41A 15/06 42/47
528,228 A * 10/1894 Horne ..... F41A 15/06 42/47

(Continued)

FOREIGN PATENT DOCUMENTS

DE 293030 C 7/1916
DE 336867 C * 5/1921

(Continued)

OTHER PUBLICATIONS

Extended European Search Report, European Patent Application No. 23425065.2 dated Apr. 30, 2024, 8 pages.

*Primary Examiner* — Gabriel J. Klein
(74) *Attorney, Agent, or Firm* — Leber IP Law; Celia H. Leber

(57) ABSTRACT

A firearm comprising at least one frame defining a housing seat of a barrel group; and a barrel group comprising at least one barrel with longitudinal development axis (A), the barrel group being mounted in a tilting manner with respect to the frame between a position in which the barrel group engages the housing seat and a position in which the barrel group is rotated with respect thereto. The barrel group comprises at least one extractor device associated with the barrel and configured to at least partially expel at least a portion of an ammunition from the at least one barrel. The extractor device is configured to selectively operate in a first mode in (Continued)

which it integrally ejects a casing of an exploded ammunition and in a second mode in which it accompanies part of an unexploded ammunition in partial exited from the at least one barrel.

18 Claims, 6 Drawing Sheets

(56) References Cited

U.S. PATENT DOCUMENTS 554,002 A * 2/1896 Parry ..... F41A 15/06 42/47
665,941 A * 1/1901 Stubbs ..... F41A 15/06 42/48
675,334 A * 5/1901 Lewis ..... F41A 15/06 42/47
717,486 A * 12/1902 Wolfersperger ..... F41A 15/06 42/48
798,469 A * 8/1905 Watson ..... F41A 15/06 42/48
858,674 A * 7/1907 Schafer ..... F41A 15/06 42/48
921,220 A * 5/1909 Fox ..... F41A 15/06 42/48
3,964,198 A * 6/1976 Waddell ..... F41A 15/06 42/48
5,459,956 A * 10/1995 Rowlands ..... F41A 17/60 42/47
5,469,649 A * 11/1995 Rowlands ..... F41A 17/50 42/47
2004/0103575 A1* 6/2004 Rousseau ..... F41A 17/62 42/75.02

FOREIGN PATENT DOCUMENTS

FR 572049 A * 5/1924
FR 1359516 A * 8/1964
GB 191322513 A * 1/1914 ..... F41A 15/06

* cited by examiner

FIG. 5
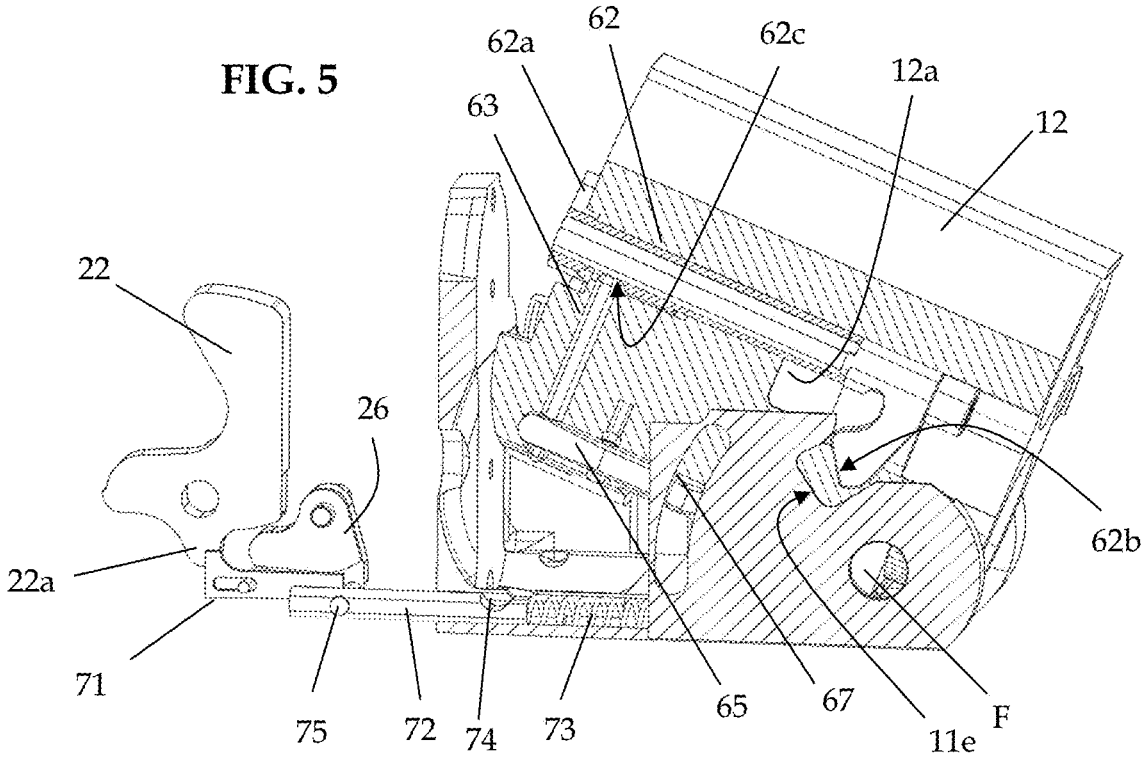
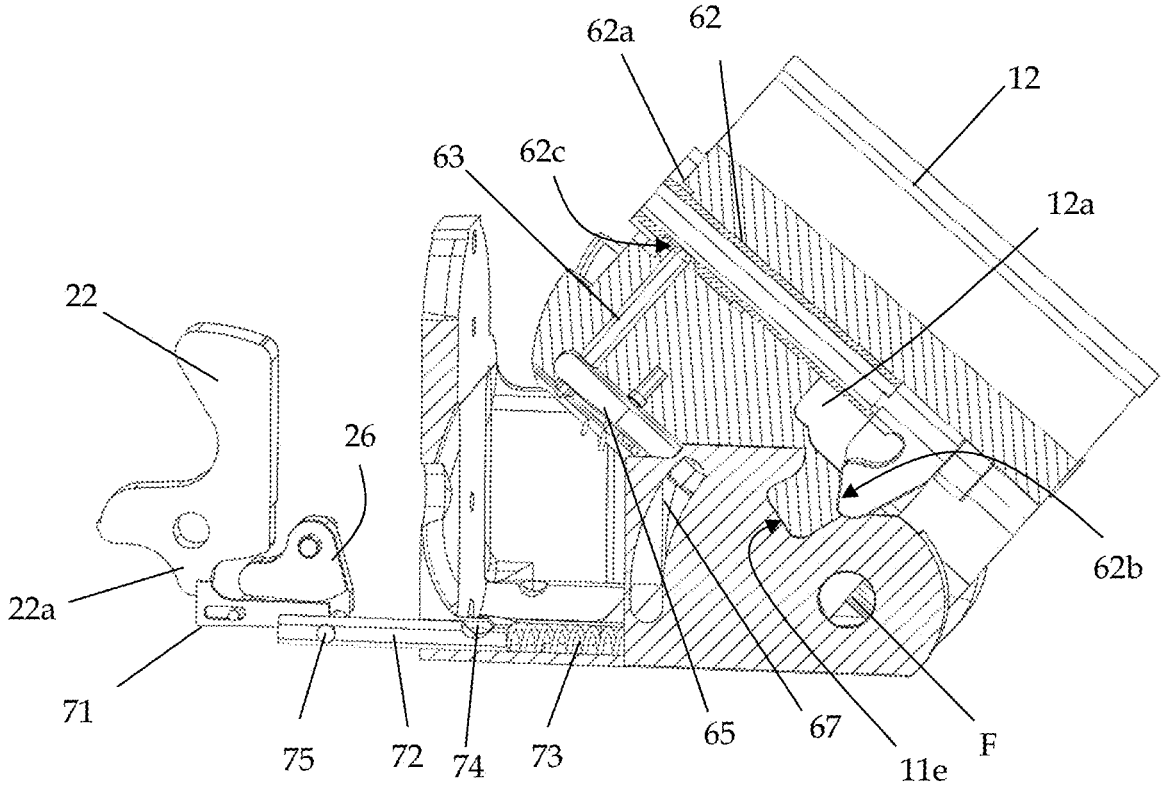
FIG. 6

FIG. 9
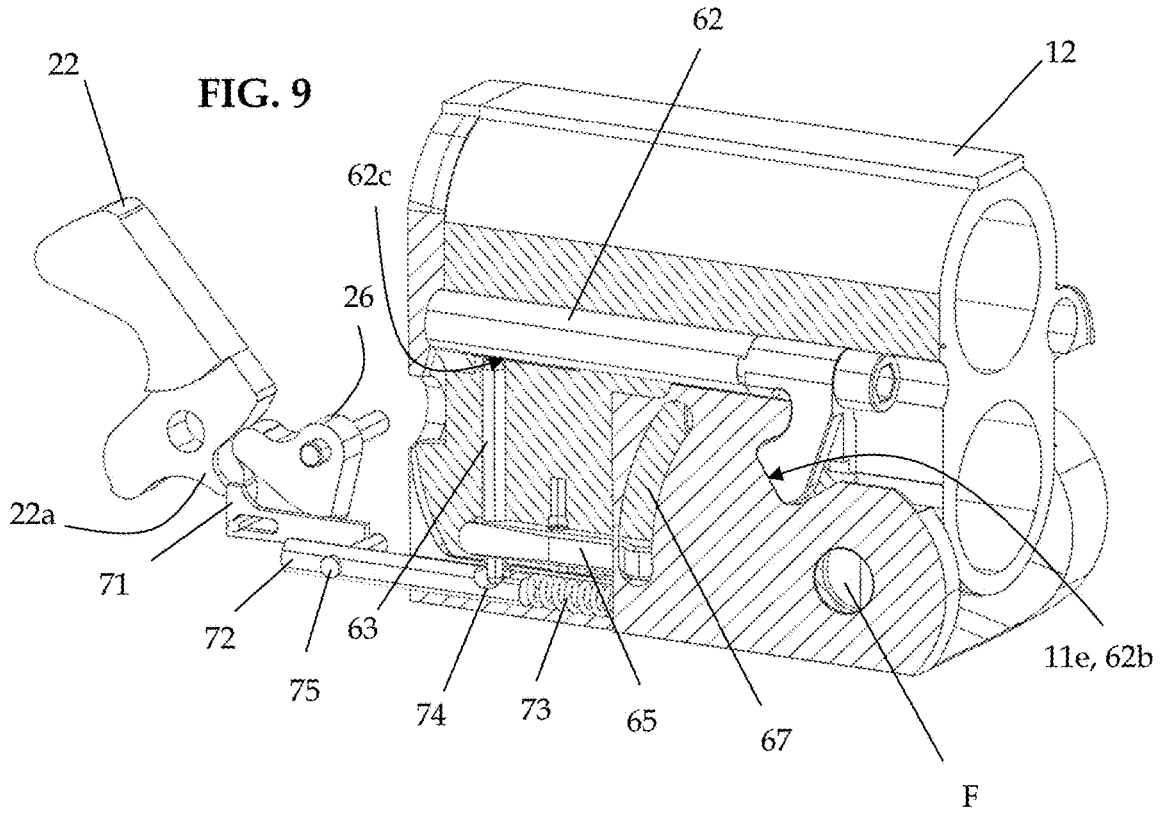
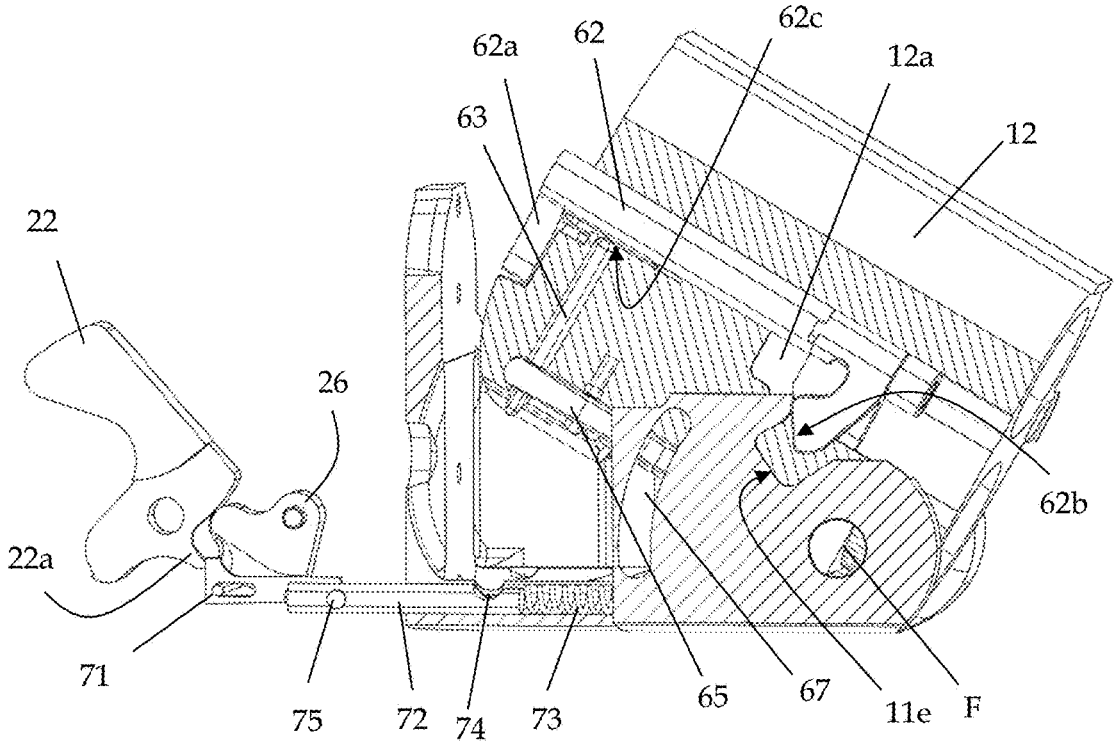
FIG. 10

BREAK-BARREL FIREARM WITH MECHANICAL EXTRACTION ASSEMBLY

RELATED APPLICATION

This application claims priority from European Patent Application No. 23425065.2, filed Dec. 1, 2023, the entire disclosure of which is incorporated herein by reference.

TECHNICAL FIELD

The present invention concerns in general a firearm, in particular a long firearm, such as a rifle, of the break-barrel type and equipped with a particularly reliable and functional extraction assembly.

BACKGROUND

"Rifle" type firearms have been around for decades in many different forms and types. Various types of rifle have been developed for many types of shooting. For example, and without limitations, there are single-shot shotguns, double-barreled shotguns (double shotgun), over/under shotguns, bolt-action shotguns, semi-automatic shotguns, and so on. Technology continues to evolve to meet the diverse needs of the shooting enthusiasts. Many factors are taken into account in the design of single- or double-barreled rifles, including appearance, weight, sensitivity, ease of use, end-use, and individual shooter's preferences.

In the barrel rifles, a break-barrel group is generally provided that allows the firearm to be brought into an open configuration in which it is possible to extract the casings and reload new ammunitions. In order to facilitate the extraction of the casings of the exploded ammunitions or unexploded ammunitions from the barrels, the firearm usually comprises an extraction assembly configured to expel the ammunition or the casing from the respective barrel or to move them so that they protrude at least partially and can therefore be extracted manually without particular difficulties.

The known extraction assemblies have a number of unresolved disadvantages. In particular, they comprise extraction devices that have a complex structure whose realization requires processes that are difficult to automate. By way of example, some known extraction assemblies comprise devices made with special notches that allow them to operate differently on an unexploded ammunition and on an exploded ammunition casing, gently accompanying the former to protrude from the barrel, and on the contrary ejecting the latter. The realization of the particular notches requires complex machining and/or finishing that often must necessarily be carried out manually.

SUMMARY

In light of the above, the problem underlying the present invention is to devise a break-barrel firearm provided with an extraction assembly that is simple to make while allowing a distinction to be made between an unexploded ammunition and a casing of an exploded ammunition.

Within the scope of this problem, an object of the present invention is to make a break-barrel firearm provided with an extraction assembly that has an easy construction structure and that is at the same time capable of operating differently on an unexploded ammunition and an exploded ammunition casing.

A further object of the present invention is to study a break-barrel firearm provided with an extraction assembly whose production can be easily automated, but which is also capable of operating at the same time an ejection of an exploded ammunition casing and a reduced movement of an unexploded ammunition such as to be able to extract it manually from the barrels.

In accordance with a first aspect thereof, the invention therefore concerns a firearm comprising at least:

- a frame defining a housing seat for a barrel group; and
- a barrel group comprising at least one barrel with longitudinal development axis, the barrel group being mounted in a tilting manner with respect to the frame between a position in which the barrel group engages the housing seat and a position in which the barrel group is rotated with respect to the housing seat.

In particular, the barrel group comprises at least one extractor device associated with the at least one barrel of the barrel group and configured to selectively operate in a first mode in which it integrally ejects a casing of an exploded ammunition and in a second mode in which it accompanies part of an unexploded ammunition in partial exited from the at least one barrel.

Further, the barrel group comprises an ejection trigger device configured to drive the at least one extractor device so as to selectively operate in the first ejection mode.

In particular, the at least one extractor device comprises:

- an engagement element configured to engage with an ammunition inserted in the at least one barrel and housed in a structure of the barrel group according to an elastic preload condition, in a sliding manner in parallel to the longitudinal development axis; and
- a retention element housed in the structure of the barrel group movably between a constraint configuration with the engagement element, in which the retention element maintains the engagement element in the elastic preload condition, and a release configuration of the engagement element, in which the engagement element is free to slide in parallel to the longitudinal development axis under the action of the elastic preload.

According to the present invention, the engagement element comprises a slot and the ejection trigger device is configured to bring the retention element into the constraint configuration with the engagement element, by bringing the retention element to engage the slot of the engagement element.

The Applicant has devised an extractor device that allows to operate at the same time an ejection of an exploded ammunition casing and a reduced movement of an unexploded ammunition so that it can possibly be extracted manually from the barrels through a simple structure and feasible by means of easily implementable production techniques.

In fact, the constraint between the elastically preloaded engagement element and the element that retains it, by preserving the elastic preload until a certain angular position is reached, is achieved through the engagement of the retention element in a slot made in the engagement element, an element that can be made using the traditional tools used in the production processes.

Moreover, said engagement is easily releasable to obtain an effective ejection under the action of the elastic preload, once the retention element frees the ammunition engagement element.

The present invention may have at least one of the preferred following features; the latter may in particular be combined with one another as desired in order to meet specific application needs.

In a variant of the invention, the frame houses at least one trigger device configured to trigger a firing of an ammunition comprised in the barrel group, the trigger device comprising at least one hammer movable between a cocked hammer condition, in which the hammer is able to act on the ammunition to cause explosion thereof and a released hammer condition in which the hammer is not able to act on the ammunition to cause explosion thereof, wherein the ejection trigger device is configured to be activated by the hammer passing from the cocked hammer condition, to the released hammer condition.

Preferably, the ejection trigger device comprises a tab group that cooperates with the hammer of the trigger device and carries a recess positioned so that:

when the hammer is in the cocked hammer condition, the recess is in a position in which the retention element can be at least partially received in the recess, moving away from the engagement element; and when the hammer is in the released hammer condition, the recess is in a position in which the retention element cannot be received in the recess, remaining constrained to the engagement element.

Advantageously, the particular structure of the extractor device and the ejection trigger device studied by the Applicant allow to operate effectively and reliably, while presenting a simple, miniaturizable structure as well as obtainable through production procedures that can be automated.

Preferably, the tab group is mounted in the frame by bridging the trigger device and the housing seat of the barrel group.

Preferably, the tab group is held resting against the hammer of the trigger device so as to assume a position more distant from the housing seat of the barrel group, in the released hammer condition, and a position closer to the housing seat of the barrel group, in the cocked hammer condition.

More preferably, the recess of the tab group is positioned so that:

when the tab group is in a position more distant from the housing seat of the barrel group, the recess is in a position in which the retention element can be at least partially received in the recess, moving away from the engagement element; and when the tab group is in a position closer to the housing seat of the barrel group, the recess is in a position in which the retention element cannot be received in the recess, remaining constrained to the engagement element.

Advantageously, this configuration allows an automatic activation of the ejection trigger device and, in turn, the activation of the ejection mode in the extractor device.

In a variant of the invention, the engagement element comprises an elongated body developing substantially in parallel to the longitudinal development axis and comprising:

an interface portion configured to engage with an ammunition inserted in the at least one barrel, the interface portion being made at a first end of the elongated body and being placed in the structure of the barrel group at the height of an outlet of the at least one barrel facing the frame, and a cam profile made at a second end of the elongated body opposite to the first, wherein the cam profile exits from the structure of the barrel group to engage with a complementary profile made on the frame.

In a variant of the invention, the extractor device comprises a clamp housed in the structure of the barrel group and configured to cooperate with the retention element to maintain it in the constraint configuration with the engagement element while the barrel group is rotated away from the housing seat.

Preferably, the clamp cooperates with a wall of the frame so that, when the barrel group overcomes a certain angular position of rotation with respect to the housing seat, the clamp frees the retention element, allowing the retention element to leave the constraint configuration with the engagement element.

Preferably, the clamp comprises a first engagement portion with the retention element and a second engagement portion in a guide made in a side of the frame, the clamp being housed in the structure of the barrel group in a rotatable manner about a rotation axis substantially parallel to an extension of the retention element and interposed between the first and second portion.

In a variant of the invention, the retention element is housed in the structure of the barrel group according to an arrangement substantially orthogonal to the engagement element, the retention element preferably being configured as a pin.

Advantageously, the specific realization of the elements that make up the ejection extractor and trigger devices allow the operation to be carried out in a simple way, realizing a firearm whose production can be automated.

In a variant of the invention, the ejection trigger device is housed in the frame, preferably in a base wall of the frame.

This configuration allows to have a compact firearm, however, robust and less subject to wear.

BRIEF DESCRIPTION OF THE DRAWINGS

Further characteristics and advantages of the present invention will become clearer from the following detailed description of some preferred embodiments thereof, made with reference to the appended drawings.

The different features in the individual configurations can be combined with each other as desired according to the following description, if the advantages resulting specifically from a particular combination are to be availed of.

In such drawings:

FIG. 1 is a perspective view of a first preferred embodiment of a firearm according to the present invention;

FIG. 2 is a partially split perspective view of the frame and a portion of the barrel group of the firearm of FIG. 1;

FIG. 3 is a view of part of the trigger device included in the frame and the extractor devices included in the barrel group of FIG. 2;

FIG. 4 is a perspective view partially in section of a portion of the trigger device of FIG. 3 and of the barrel group of FIG. 2, in a configuration with the released hammer and the barrel group closed;

FIG. 5 is a perspective view partially in section of a portion of the trigger device of FIG. 3 and of the barrel group of FIG. 2, in a configuration with the released hammer and the barrel group partially open;

FIG. 6 is a perspective view partially in section of a portion of the trigger device of FIG. 3 and of the barrel group of FIG. 2, in a configuration with the released hammer and the barrel group almost completely open;

FIG. 7 is a perspective view of the frame and of a portion of the barrel group of the firearm of FIG. 1 in which the position of the grippers in the fully open condition of the barrel group is visible;

FIG. 8 is a perspective view partially in section of a portion of the trigger device of FIG. 3 and of the barrel group of FIG. 2, in a configuration with released hammer and the barrel group fully open;

FIG. 9 is a perspective view partially in section of a portion of the trigger device of FIG. 3 and of the barrel group of FIG. 2, in a configuration with cocked hammer and barrel group closed;

Figure 2:
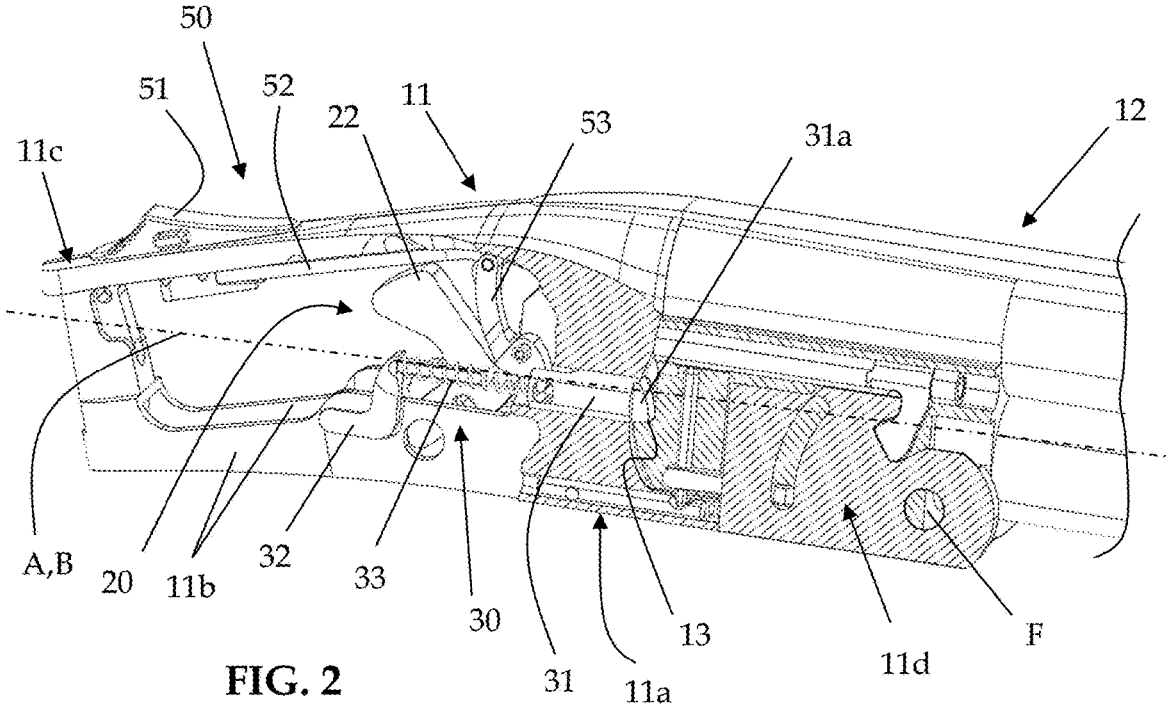
Figure 3:
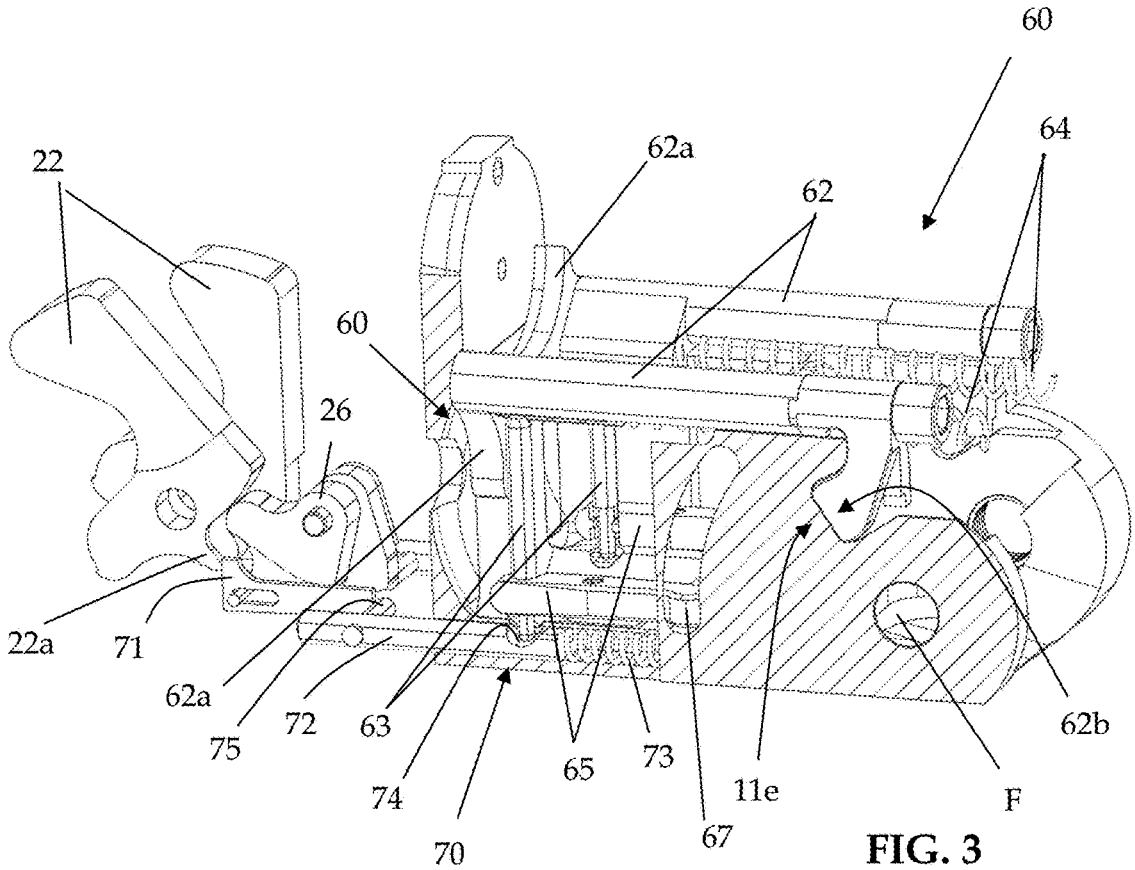
Figure 11:
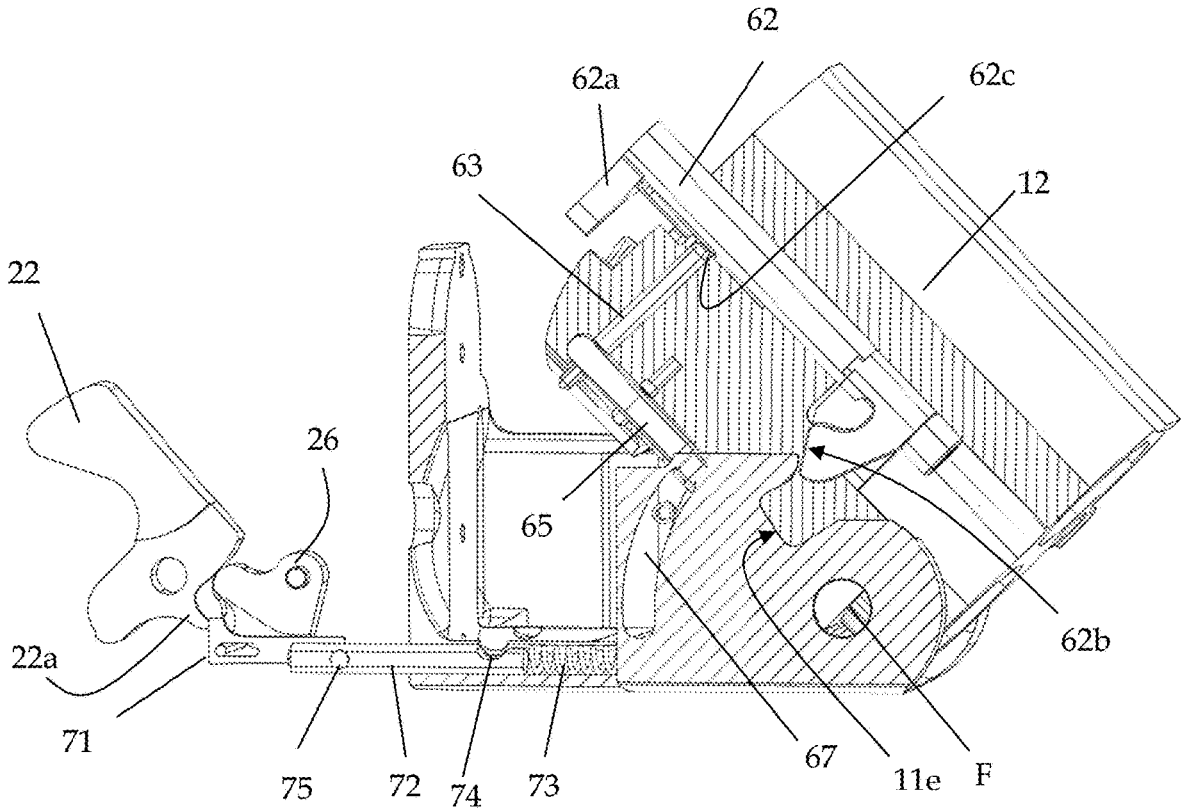

FIG. 10 is a perspective view partially in section of a portion of the trigger device of FIG. 3 and of the barrel group of FIG. 2, in a configuration with cocked hammer and barrel group partially open; and FIG. 11 is a perspective view partially in section of a portion of the trigger device of FIG. 3 and of the barrel group of FIG. 2, in a configuration with cocked hammer and barrel group completely open.

DETAILED DESCRIPTION OF THE INVENTION

For the illustration of the drawings, use is made in the following description of identical numerals or symbols to indicate construction elements with the same function. Moreover, for clarity of illustration, certain references may not be repeated in all drawings.

While the invention is susceptible to various modifications and alternative constructions, certain preferred embodiments are shown in the drawings and are described hereinbelow in detail. It must in any case be understood that there is no intention to limit the invention to the specific embodiment illustrated, but, on the contrary, the invention intends covering all the modifications, alternative and equivalent constructions that fall within the scope of the invention as defined in the claims.

The use of "for example", "etc.", "or" indicates non-exclusive alternatives without limitation unless otherwise indicated. The use of "comprises" and "includes" means "comprises or includes, but not limited to", unless otherwise indicated.

In addition, measurements, values, shapes and geometric references (such as perpendicularity and parallelism), when associated with words such as "about" or other similar terms such as "almost" or "substantially", are to be understood as "unless there are measurement errors" or "unless there are inaccuracies due to production and/or manufacturing errors" and, above all, "unless there is a slight deviation from the value, measurement, shape or geometric reference to which it is associated".

Moreover, the use of terms such as "first", "second", "main" and "secondary" does not necessarily identify an order, a relationship priority or relative position; these terms can simply be used to distinguish between similar components.

Last but not least, relative positioning terms such as "upper", "lower", "front", "rear" or "side" generally refer to the normal configuration of use, in this specific case to the grip configuration of the firearm in order to proceed with shooting.

Figure 1:
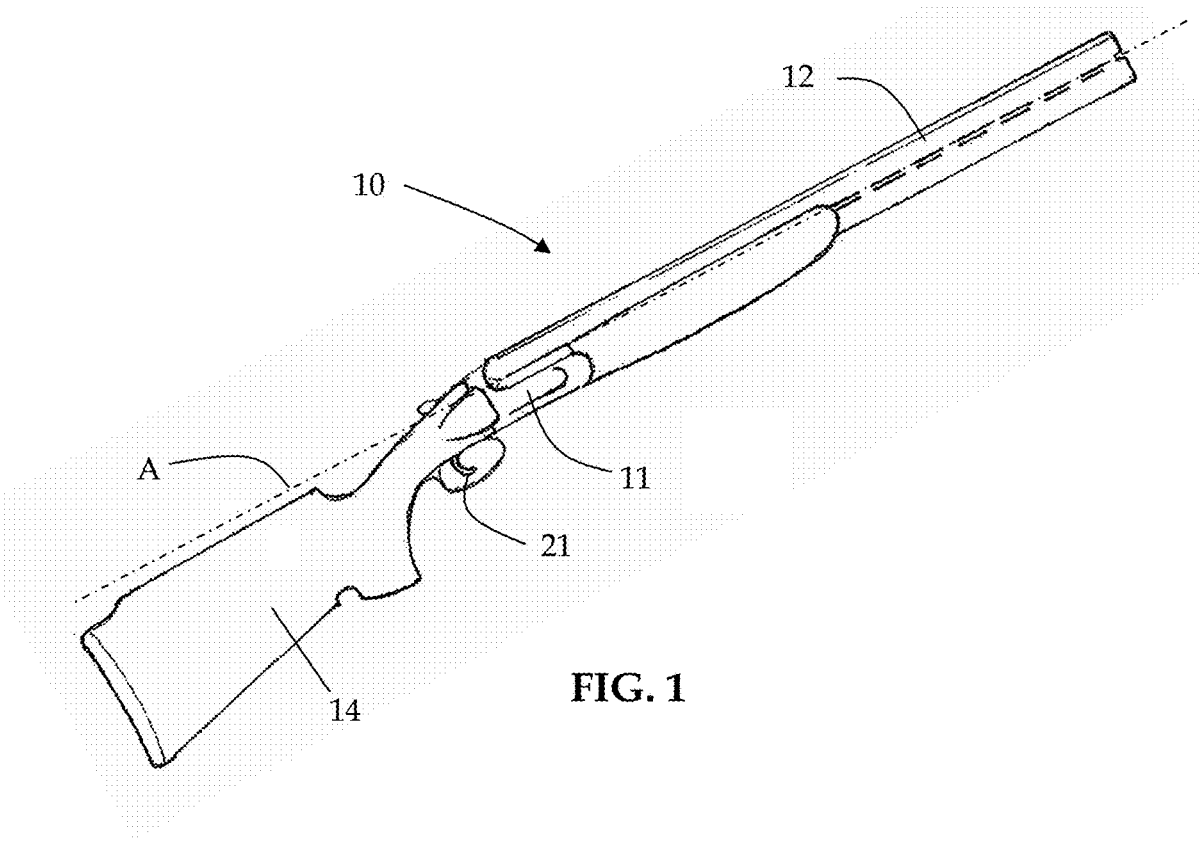

With reference to FIG. 1, a preferred embodiment of a firearm according to the present invention is illustrated, overall indicated as firearm 10.

The firearm 10, hereinafter for brevity's sake also "weapon 10", comprises a frame 11 to which a stock 14 and a barrel group 12, illustrated in FIG. 1, are mounted. The stock 14 is mounted integrally with the frame 11, while the barrel group 12 is mounted on the frame 11 in a tilting manner between a closed position in which the barrel group 12 is partially housed in a seat defined at an front portion 11*d* of the frame 11 and extends in parallel to a base wall 11*a* of the frame 11, and an open position in which the barrel group 12 is rotated with respect to the base of the frame 11. In other words, the frame 11 identifies a fulcrum F around which the barrel group 12 is hinged.

The barrel group 12 comprises a structure delimiting at least one barrel extending along a longitudinal development axis A of the barrel. By way of example, but not limitation, in the embodiment illustrated in FIG. 2, the barrel group 12 comprises two overlapping barrels extending along the longitudinal development axis A. However, in alternative embodiments, the barrel group may comprise a single barrel or two side-by-side barrels.

The frame 11 houses therein a trigger device 20 configured to trigger the firing of an ammunition and a closing device 30 configured to selectively prevent the barrel group 12 from tilting with respect to the frame 11. For clarity of illustration, FIG. 2 shows only the components of the trigger device that actually contribute to the disclosure of the present invention.

By way of example, the trigger device 20 comprises at least one trigger 21 movably mounted (for example rotatable or translatable) on the frame 11 to actuate a group of in chain-connected trigger elements and configured to act on at least one firing pin (not illustrated). For clarity of illustration, the attached figures report only part of the elements that make up the group of trigger elements and in detail there are illustrated a hammer 22 configured to act on the firing pin when it is released following a trigger operation and a recocking foot 26 (visible in FIGS. 3-11), configured to act on the hammer 22 to bring it from the released condition to the cocked condition, following the closure of the firearm 10.

The closing device 30 is configured to act between the frame 11 and the barrel group 12, when the firearm 10 is in the closed configuration; in particular, the closing device 30 is manoeuvrable between a locking position, in which it engages the barrel group 12 to prevent the tilting thereof with respect to the frame 11, and a release position, in which the closing device 30 is disengaged from the barrel group 12 and the barrel group 12 is therefore free to rotate with respect to the frame 11.

In the illustrated embodiment, the closing device 30 comprises at least one pair of clamping elements 31 with longitudinal development independent and separate from each other. As shown in FIG. 2, the clamping elements 31 are at least partially received internally to the frame 11. The clamping elements 31 develop along a respective development axis B of the clamping elements and are slidably received within the frame 11, along their own longitudinal development axis B. In particular, the clamping elements 31 are slidably housed within the frame 11 between a position in which a first end part 31*a* of the clamping element 31, preferably tip-shaped, protrudes towards a housing seat of the barrel group 12 located at the front portion 11*d* of the frame and a position in which the first end part is retracted and substantially does not protrude into the housing seat of the barrel group 12. Consequently, when the barrel group 12 is in the closed position, as illustrated in FIG. 2, the clamping elements 31 engage, each with its own first end part 31*a*, a respective hook 13 made on the barrel group 12.

The closing device 30 also comprises a pair of buffers 32, 33 each mounted on a respective side 11*b* of a rear portion 11*c* of the frame 11. Each buffer 32, 33 comprises a support 32 carrying a first elastic element 33, interposed between the support 32 and a respective clamping element 31 and exerting an axial thrust force on the respective clamping element 31 substantially in parallel to and/or substantially along the longitudinal development axis B thereof, so that, in the absence of applied forces, the clamping elements 31 protrude from the frame 11 with their first end part 31*a*, towards the housing seat of the barrel group 12.

The closing device 30 further comprises a maneuvering group 50 configured to impart to each clamping element 31 of the pair of clamping elements a force in opposition to a force exerted on each clamping element 31 by the respective buffer 32, 33.

In the illustrated embodiment, the maneuvering group 50 comprises an actuation element made as a slider 51 arranged externally to the frame 11 at the rear portion 11*c* of the frame and movable in translation in the direction of the front portion 11*d* of the frame. The slider 51 is coupled to a first lever 52 of a lever mechanism 52, 53 inside the frame 11 so as to advance it towards the front portion 11*d* of the frame 11 up to an engagement position.

The first internal lever 52 is in turn hinged to a pair of second internal levers 53 of the lever mechanism 52, 53 at a first end thereof. In particular, the first internal lever 52 is coupled to the second internal levers 53 so that an advancement of the first internal lever 52 towards the engagement position causes a rotation of the second internal levers 53.

Each of the second internal levers 53 engages, at its own second end, a respective clamping element 31 so that, when the second internal levers 53 are brought into rotation by the advancement of the first internal lever 52, the clamping elements 31 are made to translate in opposition to the force exerted by the respective buffer 32, 33. In this way both clamping elements 31 move backward, retracting the respective first end part 31*a* and decoupling it from the corresponding hook 13.

According to the present invention, the firearm 10 comprises an extraction assembly illustrated integrally in FIG. 3. The extraction assembly comprises at least one extractor device 60 associated with a respective barrel of the barrel group 12 and housed in the structure of the barrel group 12, as visible in FIG. 2. In the illustrated embodiment, two extractor devices 60 are provided.

Each extractor device 60 is configured to selectively operate in a first mode in which it integrally ejects a casing of an exploded ammunition and in a second mode in which it accompanies part of an unexploded ammunition in partial exited from the at least one barrel.

In the illustrated embodiment, each extractor device 60 comprises an engagement element 62, preferably of elongated shape, comprising an interface portion 62*a* configured to engage a rear part of an ammunition (not illustrated), with respect to an insertion condition in the respective barrel. The interface portion 62*a* is shaped as a circle portion and is located in the structure of the barrel group 12 at the height of the outlet of the barrels facing the frame 11. In FIG. 3 the structure of the barrel group 12 that delimits the barrels has been omitted for greater illustrative clarity, however, the parts of the extractor device 60 internal thereto remain visible.

The interface portion 62*a* is connected or integral to a first end of the engagement element 62. The engagement element 62 is housed in the structure of the barrel group 12 in parallel to the longitudinal development axis A. By way of example, the engagement element 62 is tubular, solid or hollow shaped, and has, at a second end thereof opposite to the first, a cam profile 62*b*. The cam profile 62*b* of the engagement element 62 exits from the structure of the barrel group 12 and is received in a seat 12*a* (visible in detail in FIGS. 5, 6 and 10) obtained on an external wall of the structure of the barrel group 12 that allows a limited translation thereof along the longitudinal development axis A of the barrels. This limited translation is also guided by the engagement of the cam profile 62*b* with a complementary profile 11*e* made on an internal wall of the side 11*b* of the frame 11.

Internally to the structure of the barrel group 12 there is also provided a second elastic element 64 which acts between a wall internal to the structure of the barrel group 12 and the engagement element 62, for example on its interface portion 62*a*, preferably according to an elastic preload condition, tending to push the engagement element 62 towards the outside of the structure of the barrel group 12 in the direction of the frame 11.

The engagement element 62 further comprises a slot 62*c* made in a lower portion of the engagement element 62. In the slot 62*c* of the engagement element 62, a first end of a retention element 63 configured as a pin housed in the structure of the barrel group 12 is selectively constrained according to an arrangement substantially orthogonal to the engagement element 62. The pin 63 is constrained to the slot 62*c* of the engagement element 62 with its first end depending on the cocking or release condition of the hammer 22 of the trigger device 20.

To this end, the firearm 10 comprises an ejection trigger device 70 configured to drive the at least one extractor device 60 so as to selectively operate in the first ejection mode. The ejection trigger device 70, housed in the frame 11, is activated on the occasion of a firing, when the hammer 22 passes from the cocked condition, to the released condition.

In the illustrated embodiment, on the occasion of a firing, the hammer 22 acts on the ejection trigger device 70, bringing the pin 63 in approach to the engagement element 62 and, in detail, in engagement with the slot 62*c* thereof 62. Conversely, in the absence of a firing, that is, in the case of a cocked hammer 22 and unexploded ammunition, the ejection trigger device 70 is not activated and the pin 63 remains in a configuration away from the engagement element 62 and disengaged from the slot 62*c* thereof 62.

In the illustrated embodiment, the ejection trigger device 70 comprises a tab group 71, 72 mounted on the base wall 11*a* of the frame 11 by bridging the trigger device 20 and the housing seat of the barrel group 12, in a sliding manner in parallel to the longitudinal development axis A. The ejection trigger device 70 also comprises a third elastic element 73 which acts on the tab group 71, 72 to push it away from the housing seat of the barrel group 12 and keep it resting against the hammer 22 of the trigger device 20 regardless of the cocked or released condition thereof 22. The hammer 22 has a nose 22*a* against which the tab group 71, 72 rests. The nose 22*a* of the hammer 22 limits the sliding of the tab group 71, 72 induced by the third elastic element 73 away from the housing seat of the barrel group 12.

The hammer 22 is configured so that the nose 22*a* is arranged more proximal to the front portion 11*d* of the frame when the hammer 22 is in the cocked condition, and more distal from the front portion 11*d* of the frame, when the hammer 22 is in the released condition. Consequently, in the released hammer condition, the tab group 71, 72 is arranged in a position more distant from the housing seat of the barrel group 12, while in the cocked hammer condition, the tab group 71, 72 is arranged in a position closer to the housing seat of the barrel group 12.

The tab group 71, 72 cooperates with the pin 63 to support it in a position of approach to the engagement element 62 and constraint to the relative slot 62*c* or, alternatively, in a position further away from the engagement element 62 in which the pin 63 does not engage the slot 62*c*.

To this end, the tab group 71, 72 comprises a recess 74 made substantially at the height of the housing seat of the barrel group 12, which cooperates with a second end of the pin 63 that protrudes from the structure of the barrel group 12 so that, when the pin 63 is with its second end housed in the recess 74, it does not engage the slot 62*c* of the engagement element 62, while when the pin 63 is not received with its second end in the recess 74, it is brought in approach to the engagement element 62, engaging the slot 62*c*.

In the illustrated embodiment, the tab group 71, 72 comprises a translation element 71 and a rod 72, both translatable in a direction parallel to the direction of the longitudinal development axis A, wherein the third elastic element 73 acts on the rod 72, while the nose 22*a* of the hammer 22 acts on the translation element. The translation element 71 engages a peg 75 constrained transversely to the rod 72 so that a translation of the translation element 71 in approach to the seat of the barrel group 12 induced by the movement of the hammer 22 is transferred to the rod 72 and, conversely, a translation of the rod 72 induced by the elastic force exerted by the third elastic element 73 is transferred to the translation element 71. In the illustrated embodiment, the translation element 71 is arranged in the frame 11 in proximity to the trigger device 20, while the rod 72 is arranged in the frame 11 substantially at the housing seat of the barrel group 12 and carries the recess 74.

In this way, in the condition of cocked hammer 22 and with the tab group 71, 72 in the position closer to the housing seat of the barrel group 12, when the barrel group 12 is housed in the frame, the pin 63 rests on the rod 72 at the recess 74.

Otherwise, in the condition of released hammer 22 and with the tab group 71, 72 in the position most distant from the housing seat of the barrel group 12, when the barrel group 12 is housed in the frame 11, the pin 63 rests against a portion of the rod 72 that does not have any recess. In this second case, the pin 63 assumes an arrangement closer to the engagement element 62, entering into engagement with its slot 62*c*.

Finally, each extractor device 60 comprises a clamp 65 housed in the structure of the barrel group 12 and configured to cooperate with the pin 63 to temporarily maintain it in the configuration approached to the engagement element 62 and of engagement with the slot 62*c* thereof 62 even during the opening of the firearm 10, while the barrel group 12 is rotated with respect to the frame 11.

The clamp 65 comprises a first engagement portion with the pin 63 and a second engagement portion in a guide 67 made in the side 11*b* of the frame 11 and is housed in the structure of the barrel group 12 in a rotatable manner around a rotation axis C (shown in FIG. 7) substantially parallel to an extension of the pin 63 and interposed between the first and second portion. The clamp 65 is also preloaded by means of a fourth elastic element (not illustrated) housed at the rotation axis C.

The sequence of FIGS. 4-8 shows the movement of the extractor device 60 during the opening of the barrel group 12 in the released hammer condition. In this case the ejection trigger device 70 has been activated by releasing the hammer 22.

Figure 4:
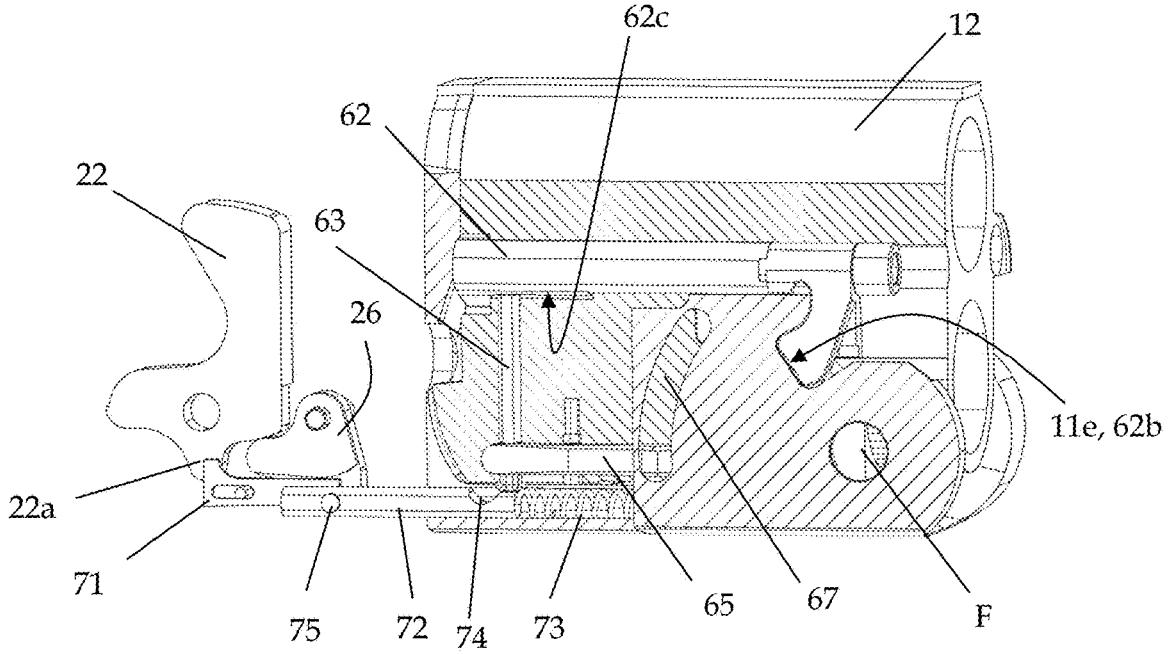

As shown FIG. 4, in fact, the release of the hammer allows 22 the translation element 71 of the ejection trigger device 70 to reach a backward position with respect to the housing seat of the barrel group 12. This position is assumed thanks to the thrust exerted by the rod 72 under the action of the third elastic element 73, which also assumes a backward position. The displacement of the rod 72 in the backward position, that is, more distant from the housing seat of the barrel group 12, causes the second end of the pin 63 to exit from the recess 74 and therefore a lifting thereof in approach to the engagement element 62, therefore in engagement of the first end of the pin 63 with the relative slot 62*c*.

During the first tilting steps of the barrel group 12, illustrated in FIGS. 5 and 6, the relative axial position of the engagement element 62 with respect to the structure of the barrel group 12 along the longitudinal development axis A is substantially the same, regardless of the opening angle of the barrel group 12. The engagement of the first end of the pin 63 in the slot 62*c* of the engagement element 62 counteracts, in fact, the preload action of the second elastic element 64 which would tend to push the engagement element 62 out of the barrel group 12.

This position of engagement with the slot 62*c* is maintained in a first angular tilting range of the barrel group 12 thanks to the action of the clamp 65 which clamps the pin 63 with its first portion. In this first angular range, the second portion of the clamp 65 is inserted into and protrudes through the guide 67. The first tilting angular range of the barrel group 12 is substantially defined by the extension of the guide 67 in which it engages the second portion of the clamp 65.

Figure 7:
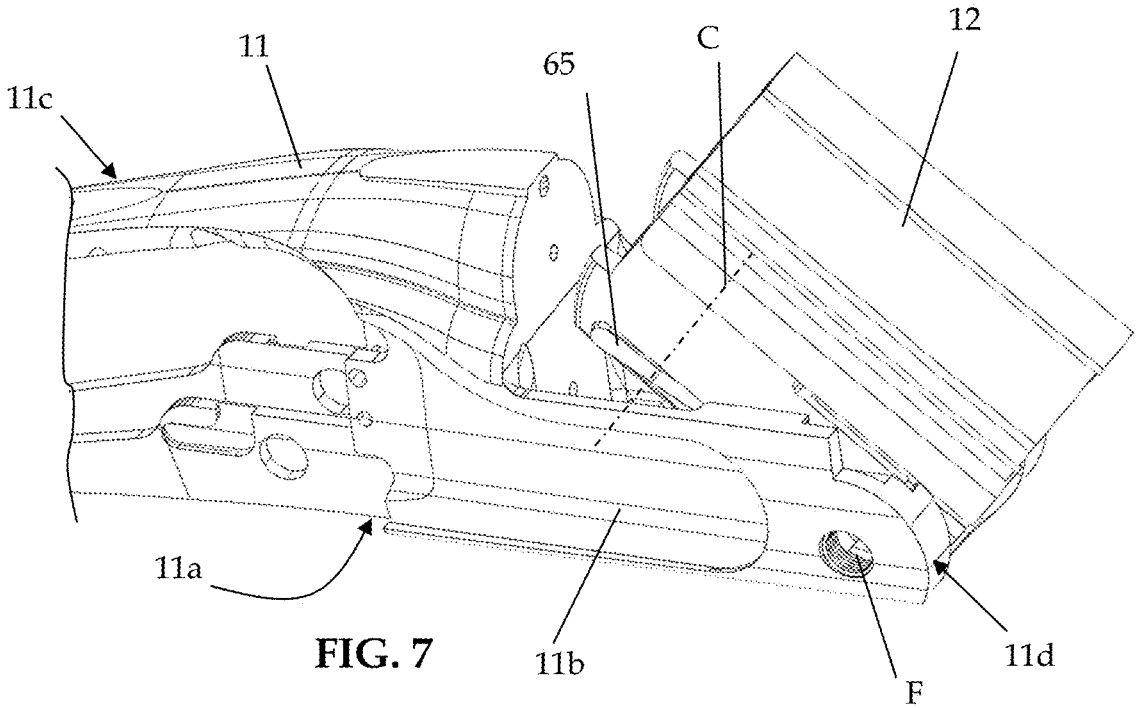

Beyond the angular position in which the second portion of the clamp 65 has reached the end of the guide 67 (see FIG. 6), a further rotation of the barrel group 12 in opening direction causes a compression of the second clamp portion 65 against the internal walls of the structure of the barrel group 12 and therefore a rotation of the first clamp portion outwardly of the structure of the barrel group 12 about the rotation axis C (see. FIG. 7).

Figure 8:
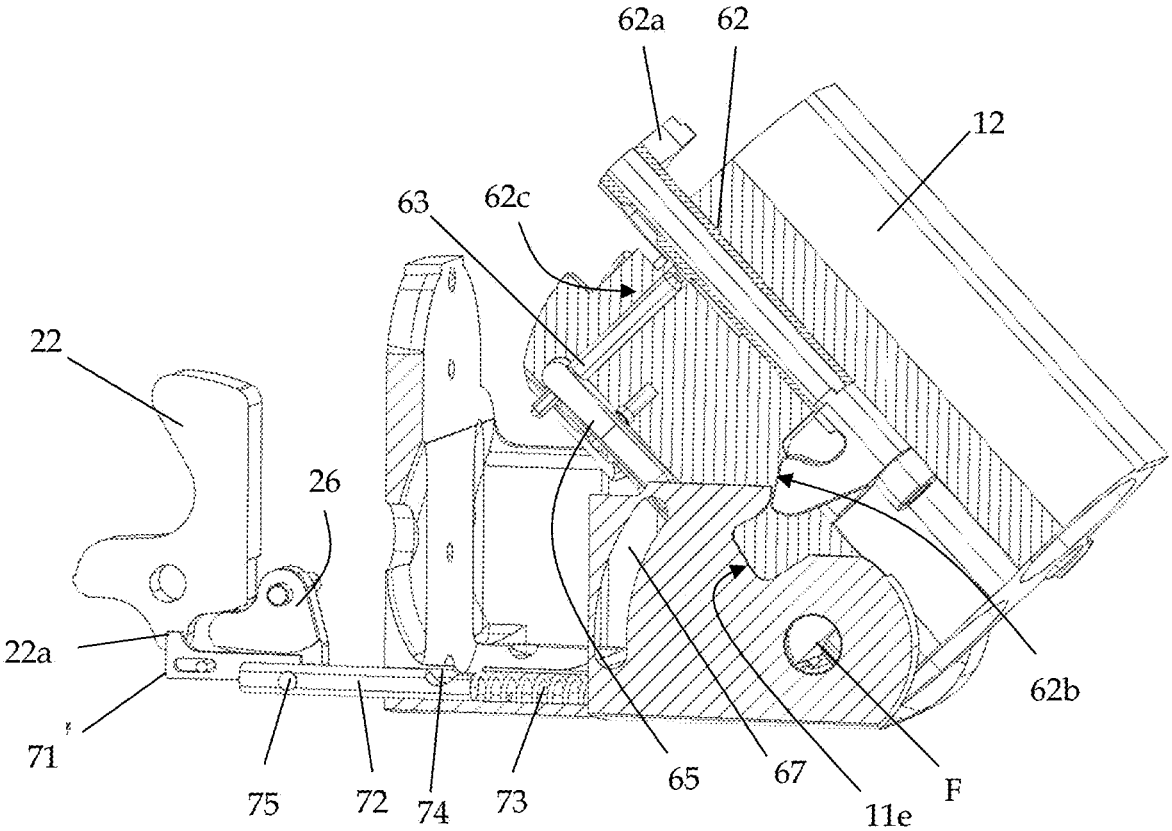

In this way, the first portion of the clamp 65 disengages the pin 63 whose first end is therefore no longer held within the slot 62*c* of the engagement element 62 and can free it. Once the slot 62*c* of the engagement element 62 is freed, the contrast of the preload action of the second elastic element 64 is lost. The second elastic element 64 therefore suddenly pushes the engagement element 62 out of the structure of the barrel group 12 for a path corresponding to the stroke that the end carrying the cam profile 62*b* can travel, as shown in FIG. 8. The casing of the exploded ammunition is thus ejected from the relative barrel.

The sequence of FIGS. 9-11 shows the movement of the extractor device 60 during the opening of the barrel group 12 in the cocked hammer condition and, therefore, of unexploded ammunition. In this case the ejection trigger device 70 is not active in order to prevent the unexploded ammunition from being projected out of the barrel group 12 in an uncontrolled manner.

As shown in fact FIG. 9, the nose 22*a* of the hammer 22 keeps the tab group 71, 72 of the ejection trigger device 70 in a position closer to the housing seat of the barrel group 12 in contrast to the action exerted by the third elastic element 73. In this case, the recess 74 is arranged substantially at the axial position in which the pin 63 is housed in the structure of the barrel group 12, allowing its second end to enter it.

By engaging the recess 74, the pin 63 frees the slot 62*c* of the engagement element 62 which, therefore, unlike the previous case, is not held against the action of the second elastic element 64. Consequently, during the tilting of the barrel group 12, illustrated in FIGS. 10 and 11, the relative axial distance of the engagement element 62 with respect to the structure of the barrel group 12 along the longitudinal development axis A gradually increases, as a function of the opening angle of the barrel group 12. In particular, the end that carries the cam profile 62*b* of the elongated body 62 is maintained by the second elastic element 64 resting against the complementary profile 11*e* made on the side 11*b* of the frame 11, sliding along it and allowing the elongated body 62 to gradually exit from the structure of the barrel group 12.

In this way, once the opening of the barrel group 12 is completed, the elongated body 62 will protrude from the structure of the barrel group 12 without having ejected the unexploded ammunition, which can then possibly be extracted manually from the barrel.

What is claimed is:

1. A firearm comprising at least:

a frame defining a housing seat for a barrel group; and a barrel group comprising at least one barrel with longitudinal development axis (A), the barrel group being mounted in a tilting manner with respect to the frame between a position in which the barrel group engages the housing seat and a position in which the barrel group is rotated with respect to the housing seat, wherein the barrel group comprises, at least one extractor device associated with the at least one barrel of the barrel group and configured to selectively operate in a first mode in which it integrally ejects a casing of an exploded ammunition and in a second mode in which it accompanies part of an unexploded ammunition in partially exiting from the at least one barrel, and an ejection trigger device configured to drive the at least one extractor device so as to selectively operate in the first ejection mode, wherein the at least one extractor device comprises:

an engagement element configured to engage with an ammunition inserted in the at least one barrel and housed in a structure of the barrel group according to an elastic preload condition, in a sliding manner in parallel to the longitudinal development axis (A); and a retention element housed in the structure of the barrel group movably between a constraint configuration with the engagement element, in which the retention element maintains the engagement element in the elastic preload condition, and a release configuration of the engagement element, in which the engagement element is free to slide in parallel to the longitudinal development axis (A) under the action of the elastic preload, wherein the engagement element comprises a slot and the ejection trigger device is configured to bring the retention element into the constraint configuration with the engagement element by bringing the retention element to engage the slot of the engagement element, and wherein the extractor device comprises a clamp housed in the structure of the barrel group and configured to cooperate with the retention element to maintain it in the constraint configuration with the engagement element while the barrel group is rotated away from the housing seat.

2. The firearm according to claim 1, wherein the frame houses at least one trigger device configured to trigger a firing of an ammunition comprised in the barrel group, the trigger device comprising at least one hammer movable between a cocked hammer condition, in which the hammer is able to act on the ammunition to cause explosion thereof, and a released hammer condition in which the hammer is not able to act on the ammunition to cause explosion thereof, wherein the ejection trigger device is configured to be activated by the hammer passing from the cocked hammer condition, to the released hammer condition.

3. The firearm according to claim 2, wherein the ejection trigger device comprises a tab group that cooperates with the trigger device and carries a recess positioned such that:

when the hammer of the trigger device is in the cocked hammer condition; the recess is in a position in which the retention element can be at least partially received in the recess, moving away from the engagement element; and when the hammer (22) of the trigger device (20) is in the released hammer condition, the recess (74) is in a position in which the retention element (63) cannot be received in the recess (74), remaining constrained to the engagement element (62).

4. The firearm according to claim 3, wherein the tab group is mounted in the frame by bridging the trigger device and the housing seat of the barrel group.

5. The firearm according to claim 3, wherein the tab group is held resting against the hammer of the trigger device so as to assume a position more distant from the housing seat of the barrel group, in the released hammer condition, and a position closer to the housing seat of the barrel group, in the cocked hammer condition.

6. The firearm according to claim 1, wherein the engagement element comprises an elongated body developing substantially in parallel to the longitudinal development axis (A) and comprising:

an interface portion configured to engage with an ammunition inserted in the at least one barrel, the interface portion being made at a first end of the elongated body and being placed in the structure of the barrel group at the height of an outlet of the at least one barrel facing the frame, and a cam profile made at a second end of the elongated body opposite to the first, wherein the cam profile exits from the structure of the barrel group to engage with a complementary profile made on the frame.

7. The firearm according to claim 1, wherein the clamp cooperates with a wall of the frame so that, when the barrel group overcomes a certain angular position of rotation with respect to the housing seat, the clamp frees the retention element, allowing the retention element to leave the constraint configuration with the engagement element.

8. The firearm according to claim 1, wherein the clamp comprises a first engagement portion with the retention element and a second engagement portion in a guide made in a side of the frame, the clamp being housed in the structure of the barrel group in a rotatable manner about a rotation axis (C) substantially parallel to an extension of the retention element and interposed between the first and second engagement portions.

9. The firearm according to claim 1, wherein the retention element is housed in the structure of the barrel group according to an arrangement substantially orthogonal to the engagement element.

10. The firearm according to claim 1, wherein the retention element is configured as a pin.

11. The firearm according to claim 1, wherein the ejection trigger device is housed in the frame.

12. The firearm according to claim 1, wherein the ejection trigger device is housed in a base wall of the frame.

13. The firearm according to claim 1, wherein the frame houses at least one closing device configured to act between the frame and the barrel group so as to selectively prevent the barrel group from tilting with respect to the frame, wherein the closing device comprises:

at least one pair of clamping elements with longitudinal development independent of each other, the clamping elements being slidably housed inside the frame, each along its own longitudinal development axis; and at least one pair of buffers each coupled to a respective clamping element so as to exert an axial thrust force on the respective clamping element substantially in parallel to and/or substantially along the respective longitudinal development axis.

14. The firearm according to claim 13, wherein each buffer of the pair of buffers comprises a support carrying a first elastic element interposed between the support and a respective clamping element.

15. The firearm according to claim 13, wherein each buffer of the pair of buffers is mounted on a respective side of a rear portion of the frame.

16. The firearm according to claim 13, wherein each clamping element of the pair of clamping elements is housed inside the frame in a sliding manner between a position in which a first end part of the clamping element protrudes towards a housing seat of the barrel group located at a front portion of the frame and a position in which the first end part is retracted and substantially does not protrude into the housing seat of the barrel group.

17. The firearm according to claim 13, wherein the closing device comprises a maneuvering group configured to impart to each clamping element of the pair of clamping elements a force in opposition to a force exerted by a buffer on the respective clamping element.

18. The firearm according to claim 17, wherein the maneuvering group comprises an actuation element arranged externally to the frame, the actuation element being made as a slider movable in translation in the direction of the front portion of the frame and is coupled to a lever mechanism inside the frame that engages the pair of clamping elements, so that an advancement of the slider actuation element towards the front portion of the frame causes a translation of the pair of clamping elements in opposition to the force exerted by the respective buffers.

* * * * *